US006135789A

United States Patent [19]

Lai et al.

[11] Patent Number: 6,135,789

[45] Date of Patent: Oct. 24, 2000

[54] ELECTRICAL CONNECTOR

[75] Inventors: Chin-Yi Lai; Kun-Tsan Wu, both of Tu-Chen; Johnson Yang, Tai-Shan, all of Taiwan

[73] Assignee: Hon Hai Precision Ind. Co., Ltd., Taipei Hsien, Taiwan

[21] Appl. No.: 09/266,249

[22] Filed: Mar. 10, 1999

[30] Foreign Application Priority Data

Mar. 9, 1998 [TW] Taiwan ..... 87203457

[51] Int. Cl.[7] ..... H01R 12/20

[52] U.S. Cl. ..... 439/79; 439/567

[58] Field of Search ..... 439/79, 567, 569–573, 439/607

[56] References Cited

U.S. PATENT DOCUMENTS 5,584,709 12/1996 Kiat ..... 439/79
5,667,392 9/1997 Kocher et al. ..... 439/79
5,711,678 1/1998 Wu ..... 439/79
5,879,171 3/1999 Wu ..... 439/79
5,893,764 4/1999 Long ..... 439/79

*Primary Examiner*—Gary F. Paumen
*Attorney, Agent, or Firm*—Wei Te Chung

[57] ABSTRACT

An electrical connector includes a housing forming a plurality of passages therein for receiving a plurality of terminal pins and a spacer fixed to the housing by means of fasteners. The spacer forms a plurality of channels for extension of tail ends of the terminal pins therethrough. The spacer has a board mating surface distanced from a bottom face of the connector. The board mating surface is positioned on the circuit board to mount the connector to the circuit board. At least a portion of the connector is located below the circuit board, and the remaining portion of the connector is located above the circuit board. The spacer forms two spaced slots for each receiving a flat boardlock therein which has board engaging legs for insertion into holes provided on the circuit board. The boardlock has a section retained by an expanded end of the fastener for securing the boardlock to the spacer.

17 Claims, 10 Drawing Sheets

ELECTRICAL CONNECTOR

BACKGROUND OF THE INVENTION

1. Field of the Invention

The present invention generally relates to an electrical connector, and in particular to an electrical connector mounted to a circuit board wherein at least a portion of the connector is located below the circuit board thereby reducing the height of the connector above the circuit board thus more efficiently using an interior space of a device in which the circuit board is mounted.

2. The Prior Art

Connectors to be fixed on a circuit board usually include mounting means, such as boardlocks, to be mounted to the circuit board. Examples of such connectors are disclosed in U.S. Pat. Nos. 4,721,473, 4,824,398, 4,842,552, 4,907,987 and 5,066,237.

In FIGS. 1 and 2 of the attached drawings, a conventional electrical connector 10 is shown. The connector 10 comprises an insulative housing 16 to which two boardlocks 12 are fixed by means of fasteners 14. The fasteners 14 also secure a metal shell 18 to an outer face of the housing 16. The boardlocks 12 comprise resilient sections or legs that elastically deform during insertion into holes provided on a circuit board 22. A plurality of terminal pins 20 are partially received and retained in passages formed in the housing 16 by means of a retaining plate 24. Tail ends of the terminal pins 20 extend beyond the connector housing 16, usually from a bottom face of the housing 16, and electrically engage with the circuit board 22. In such a conventional arrangement, the connector 10 is positioned on a top surface 22*a* of the circuit board 22 so that electronic elements, such as memory module and power transistor, must also be mounted on the top surface 22*a*. Thus, the opposite bottom surface 22*b* of the circuit board 22 does not have any elements mounted thereon.

Following the trend of minimization of electronic devices, space efficiency becomes a major challenge for computer designers. Thus, it is desirable to have an electrical connector which promote use of both surfaces of the circuit board.

Furthermore, in the conventional design shown in FIGS. 1 and 2, the terminal pins 20 are secured to the housing 16 only by the retaining plate 24 which is retained on the housing 16 by means of two barbed arms 26. Such a weak mechanical coupling may cause the retaining plate 24 to be easily deformed and thus become separated from the housing 16, leading to detachment of the terminal pins 20 from the connector 10.

Hence, it is desirable to have an electrical connector structure that overcomes the problems discussed above.

SUMMARY OF THE INVENTION

An object of the present invention is to provide an electrical connector mounted to a circuit board wherein a portion of the connector extends beyond a bottom surface of the circuit board thereby reducing the space required for accommodating the connector above the circuit board.

Another object of the present invention is to provide an electrical connector which comprises board engaging means that is easily positioned and is electrically connected to the connector by means of fasteners that fix the board engaging means to the connector for grounding purposes.

A further object of the present invention is to provide an electrical connector having means for retaining tail ends of terminal pins thereof in a suitable position thereby allowing the connector to be mounted to a circuit board that comprises electronic elements on both sides thereof and thus reduces the height of the connector above the circuit board.

Yet another object of the present invention is to provide an electrical connector having a housing comprised of two insulative members fixed together by means of fasteners which also secure boardlocks to the housing thereby strengthening the structure of the connector.

To achieve the above objects, in accordance with the present invention, an electrical connector is provided, comprising an insulative housing and a spacer also made of an insulative material fixed to the housing by means of fasteners and retaining a plurality of terminal pins therebetween. The terminal pins are partially received in passages formed in the housing and tail ends of the terminal pins extending through channels formed in the spacer to engage with a circuit board. The spacer also comprises a board mating surface positioned on the circuit board. The board mating surface is distanced from a bottom face of the housing in a direction substantially normal to the board mating surface and a portion of the connector is located below the circuit board thereby reducing the height of the connector above the circuit board.

In addition, the spacer is provided with two spaced boardlock retention slots each receiving and retaining a boardlock therein which has an extension received in a retaining space formed in the spacer. The fasteners that fix the spacer to the housing engage with the extensions of the boardlocks and thus fix the boardlocks to the housing. Thus, a secure mechanical connection is provided between the housing, the spacer and the boardlocks.

BRIEF DESCRIPTION OF THE DRAWINGS

The present invention will be apparent to those skilled in the art after reading the following description of the preferred embodiments thereof, with reference to the accompanying drawings, in which.

DETAILED DESCRIPTION OF THE PREFERRED EMBODIMENTS

Figure 1:
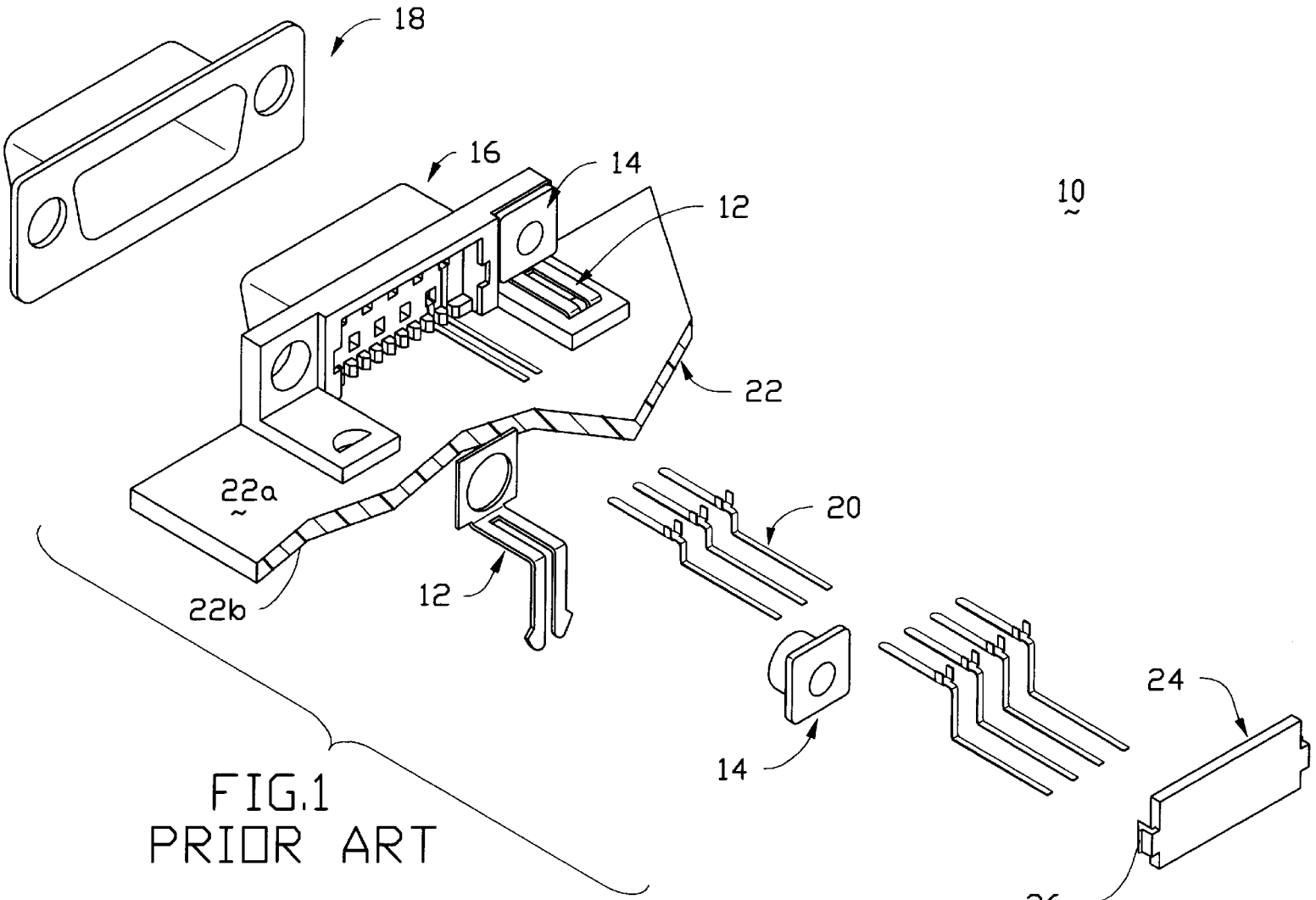
FIG.1 PRIOR ART
FIG. 1 is an exploded view of a conventional electrical connector and a portion of a circuit board to which the connector is to be mounted.
Figure 2:
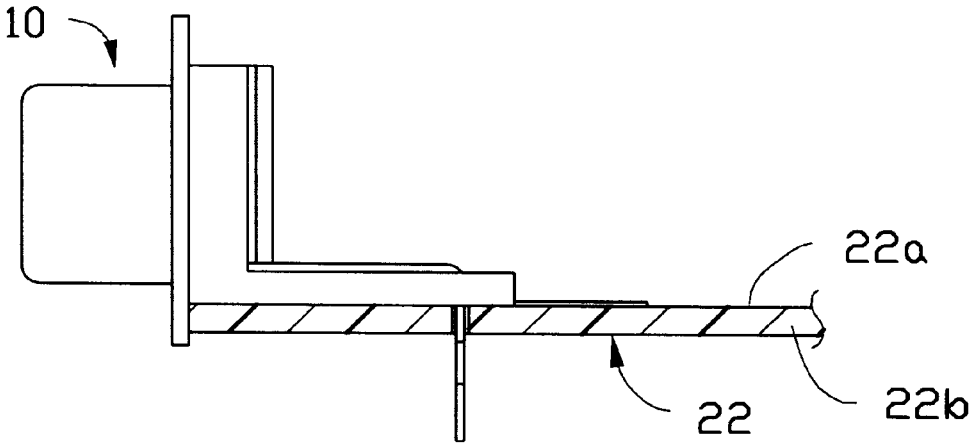
FIG.2 PRIOR ART
FIG. 2 is a side elevational view of the assembled connector of FIG. 1 mounted to a circuit board.
Figure 3:
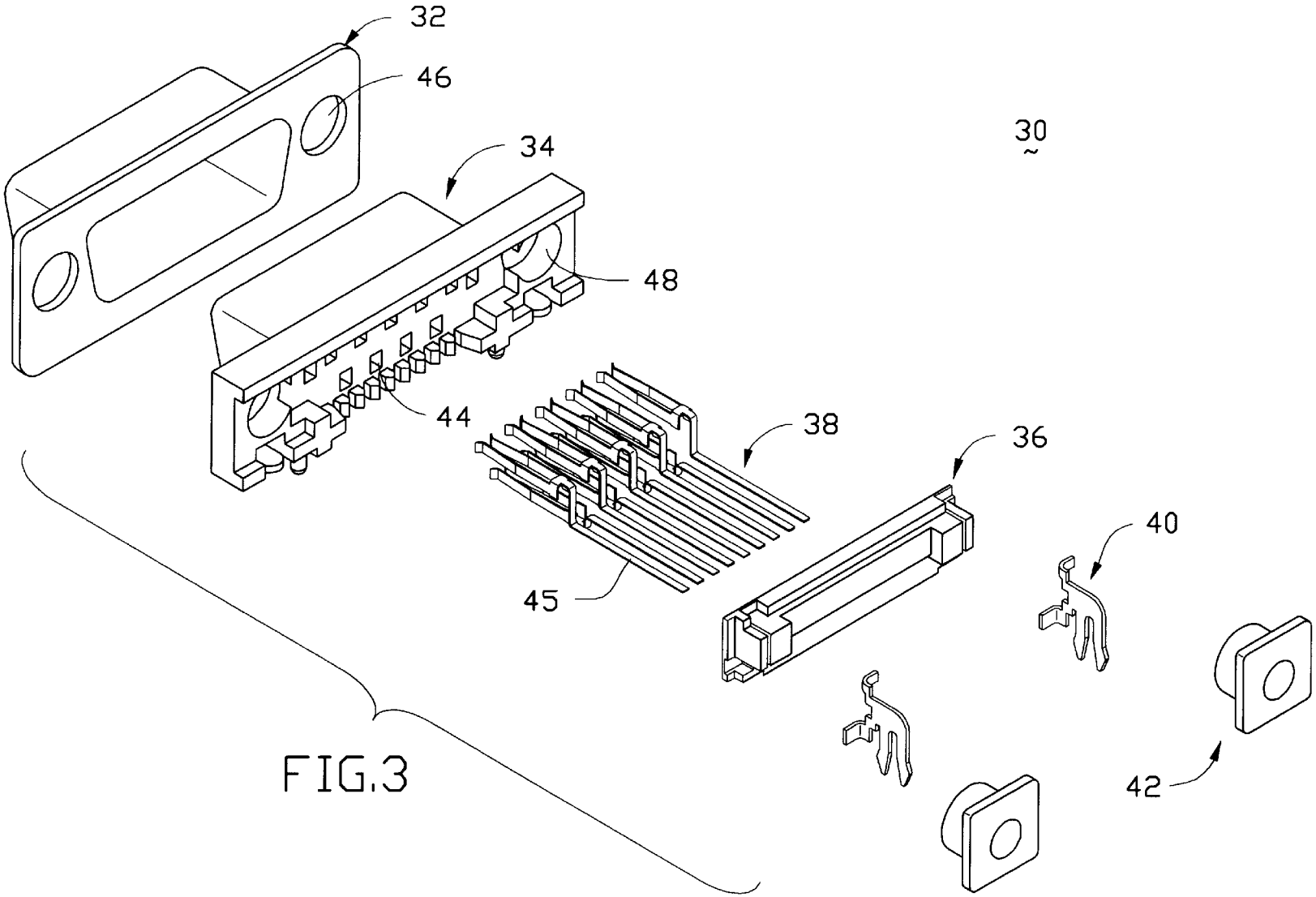
FIG. 3 is an exploded view of an electrical connector constructed in accordance with the present invention.

With reference to the drawings and in particular to FIG. 3, wherein an electrical connector constructed in accordance with the present invention, generally designated with reference numeral 30, is shown, the connector 30 of the present invention comprises a connector housing 34 and a spacer 36, both made of insulative material, fixed together and retaining a plurality of terminal pins 38 therebetween. A shielding shell 32, preferably made of metal, is fit over and secured to a projecting portion of the housing 34.

The housing 34 forms a plurality of passages 44 each receiving and retaining one of the terminal pins 38 therein. Tail sections 45 of the terminal pins 38 extend through corresponding channels 50 formed in the spacer 36 (see FIG. 4) and projecting therebeyond to engage with a circuit board 74 (see FIG. 9).

Figure 4:
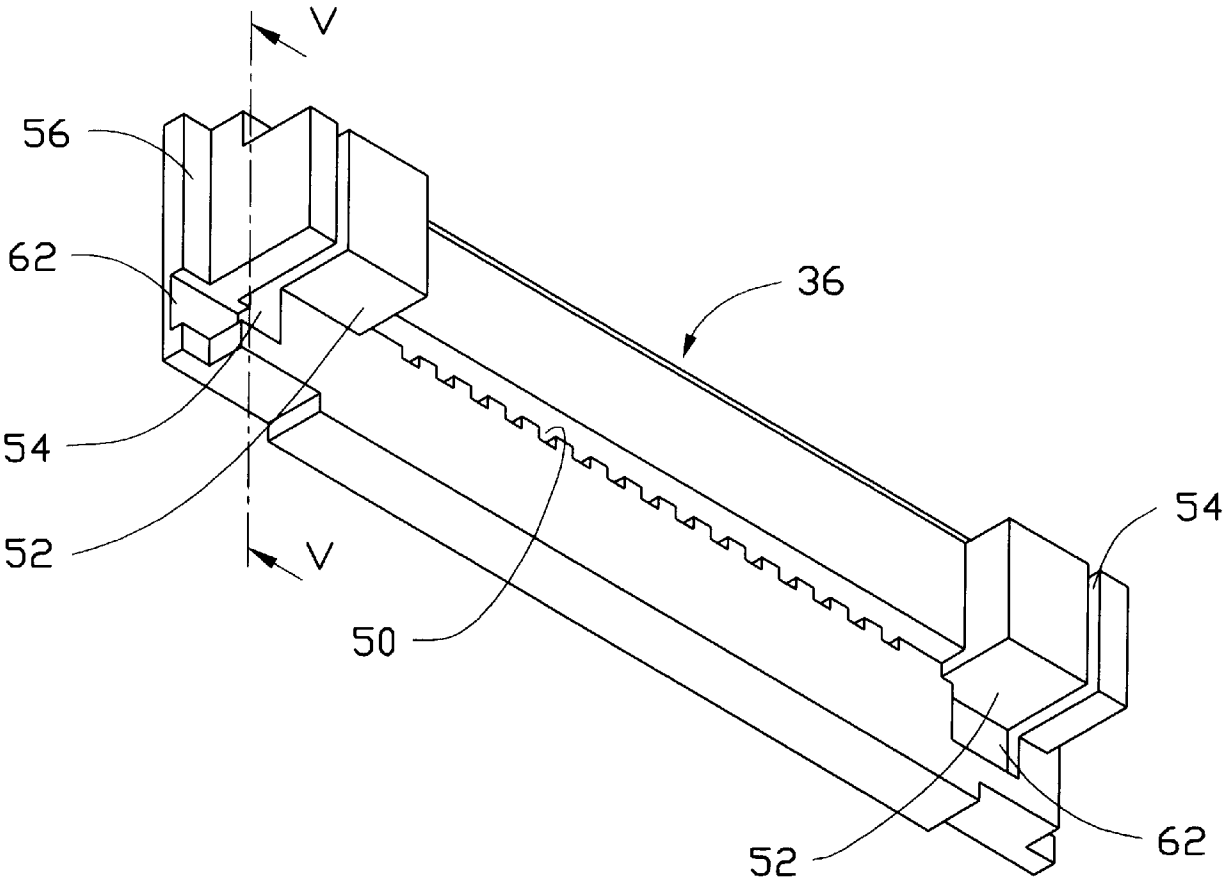
FIG. 4 is a perspective view of a spacer incorporated in the electrical connector of the present invention.
Figure 9:
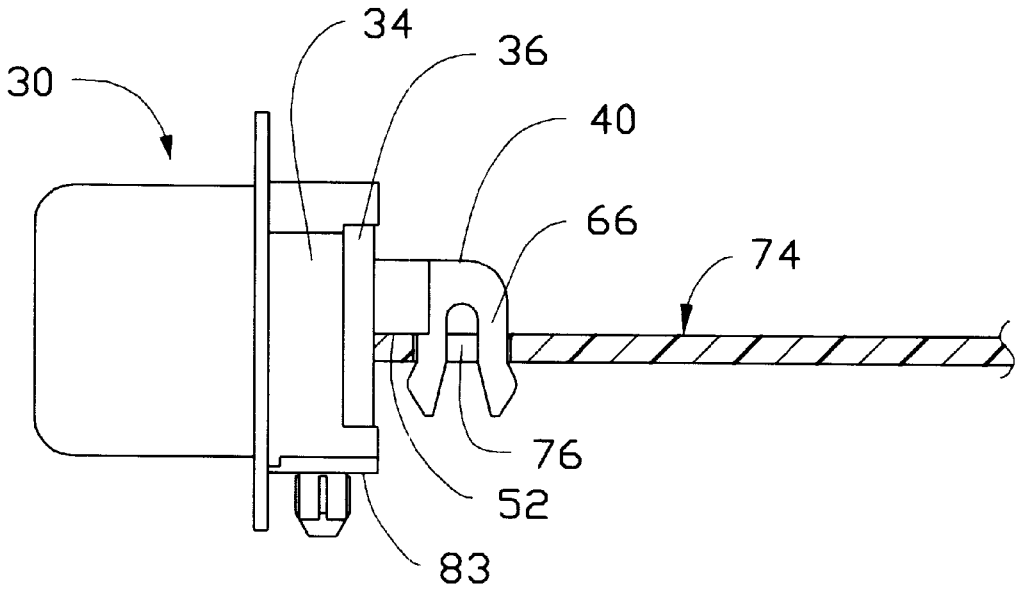
FIG. 9 is a side elevational view of the assembled connector of the present invention mounted on a circuit board.

As particularly shown in FIG. 4, the spacer 36 comprises at least one, and preferably two, projections each having a bottom face defining a board mating surface 52 by which the spacer 36 and thus the connector 30 may be positioned on the circuit board 74 (FIG. 9). In the embodiment illustrated, the spacer 36 comprises two such projections on opposite ends thereof. The board mating surface 52 is spaced from a bottom face 83 of the housing 34 in a direction substantially normal to the board mating surface 52 (FIG. 9). When the connector 30 is mounted on the circuit board 74 and board mating surface 52 is positioned on a surface of the circuit board 74 and at least a portion of the connector 30 is located below the circuit board 74 thereby reducing the height of the connector 30 above the circuit board 74.

Figure 5:
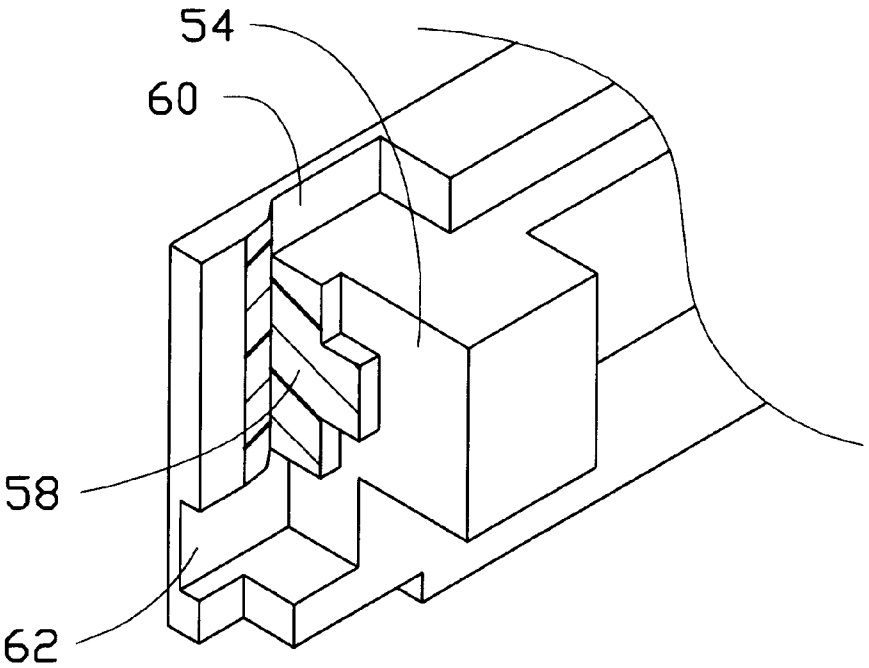
FIG. 5 is a perspective view of a portion of the spacer, partially cutaway along line V—V of FIG. 4.

The spacer 36 also comprises at least one boardlock retention slot 54 (FIG. 5) within which a boardlock 40, serving as board engaging means, is received and retained. In the embodiment illustrated, the spacer 36 has two such boardlock retention slots 54 respectively formed on the two projections that define the board mating surfaces 52. Each of the boardlock retention slots 54 comprises a first retaining space 60 and a second retaining space 62 in communication therewith. Preferably the retaining spaces 60, 62 are defined transverse to the slot 54 and in opposite directions, as shown.

Figure 6:
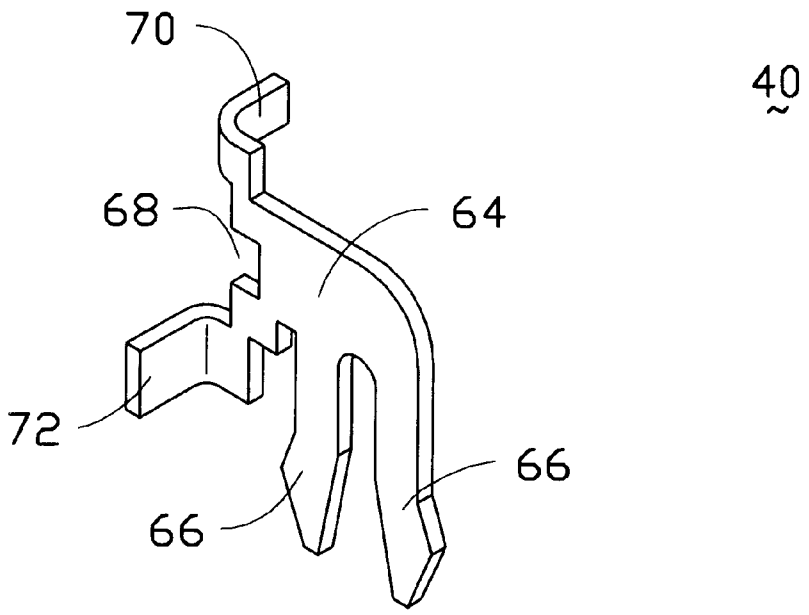
FIG. 6 is a perspective view of a boardlock incorporated in the connector of the present invention.
Figure 7:
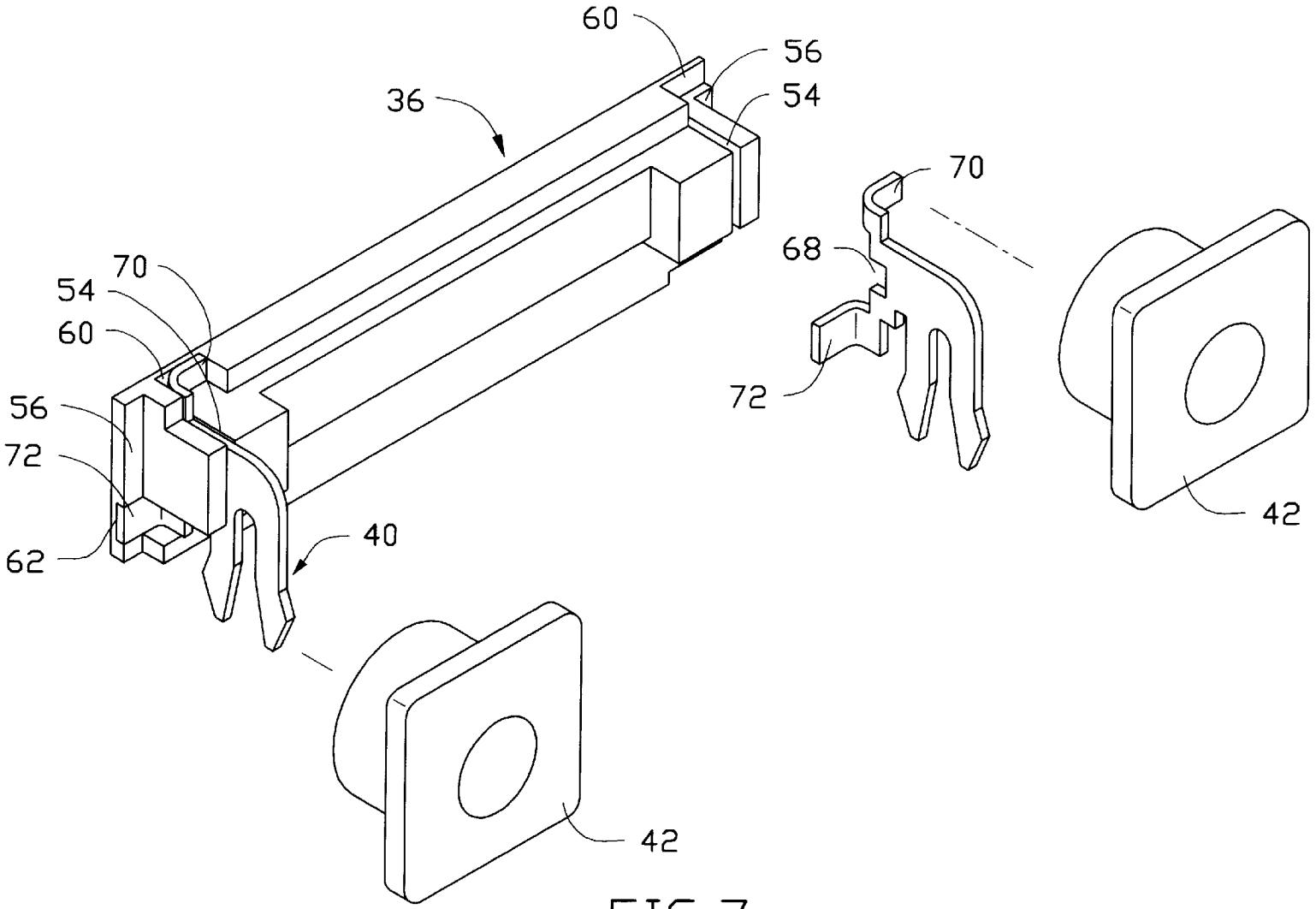
FIG. 7 is a perspective view showing the spacer, the boardlocks and two fasteners in accordance with the present invention.

With reference to FIG. 6, each boardlock 40, preferably made by stamping a metal plate, comprises a body 64 received and retained in the corresponding boardlock retention slot 54 of the spacer 36 and a portion of the body 64 projects beyond the boardlock retention slot 54, as shown in FIG. 7. The boardlock 40 has two resilient retention legs 66 extending from the portion of the body 64 that projects beyond the boardlock retention slot 54. The legs 66 are adapted to be received in a corresponding mount hole 76 defined in the circuit board 74 (FIG. 9). The legs 66 are spaced from each other and elastically deform toward each other to facilitate insertion of the legs 66 through the corresponding mounting hole 76. Preferably, the legs 66 are provided with inclined free ends to further facilitate insertion of the legs 66 into the mounting hole 76.

Figure 8:
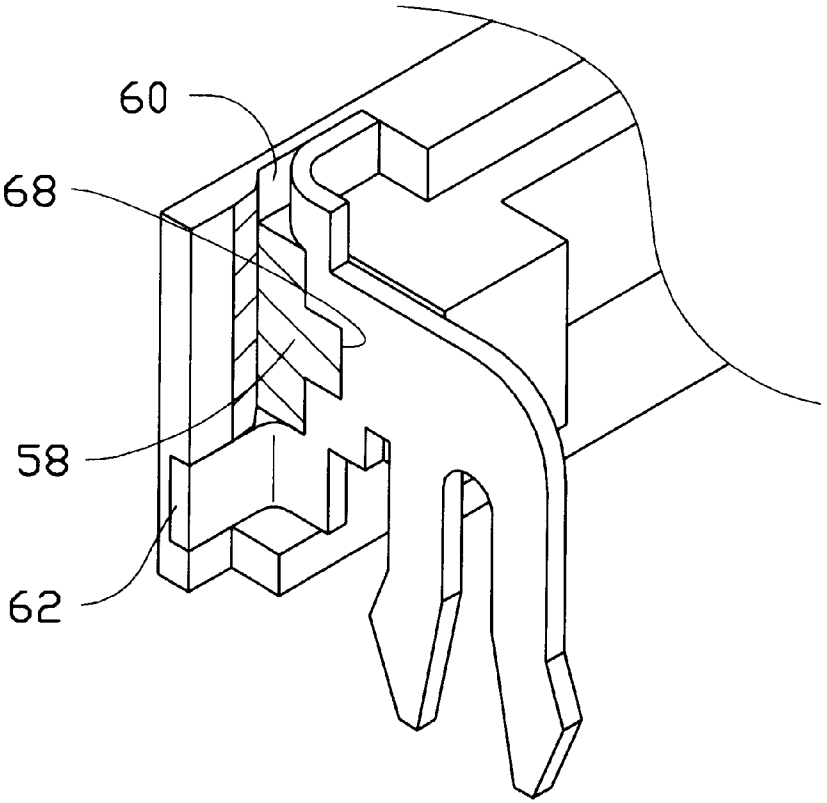
FIG. 8 is a view of the spacer similar to FIG. 5 with a boardlock received therein.

The body 64 of the boardlock 40 further comprises a cutout 68 for engaging with a projection 58 (FIG. 8) formed inside the boardlock retention slot 54 to retain the boardlock 40 in position inside the boardlock retention slot 54.

Two extensions 70, 72 are formed on the body 64 of the boardlock 40 whereby the extensions 70 and 72 are substantially transverse to the body 64 and extend in opposite directions. The extensions 70, 72 correspond in position and shape to the corresponding first and second retaining spaces 60, 62 of the boardlock retention slots 54 and are respectively received therein. Preferably, the extensions 70, 72 have such a thickness whereby when the extensions 70, 72 are received in the corresponding retaining spaces 60, 62, an exposed surface of each of the extensions 70, 72 is substantially coplanar with a surface of an edge flange 56 of the spacer 36 thereby defining a smooth, continuous extension of the surface.

The housing 34 is provided with a pair of holes 48 on opposite ends thereof for receiving fasteners 42 having an expanded end. The fasteners 42 extend through corresponding holes 46 provided on the shell 32 for securing the housing 34 and the shell 32 together. The holes 48 are positioned on the housing 34 whereby when the spacer 36 is attached thereto, the edge flanges 56 are positioned adjacent to the corresponding holes 48 and the expanded ends of the fasteners 42 engage with the edge flanges 56 to secure the spacer 36 to the housing 34. The expanded end of each of the fasteners 42 engages with one of the extensions 70, 72 of each boardlock 40. Thus, the boardlock 40 is firmly secured in the corresponding boardlock retention slot 54 and a strong mechanical connection is formed between the housing 34, the spacer 36 and the boardlocks 40. As a result, the connector 30 has a durable structure.

Preferably, the fasteners 42 are made of a conductive material, such as metal, so that the engagement between the fasteners 42 and the corresponding extension 70, 72 of the boardlock 42 and the engagement between the fasteners 42 and the shell 32 establish an electrical connection between the shell 32 and the boardlock 42 for grounding purposes.

As seen in FIG. 9, the connector 30 is mounted on the circuit board 74. The board mating surfaces 52 contact the circuit board 74 and the connector 30 is secured thereto by the engagement between the legs 66 of the boardlocks 40 and the mounting holes 76 of the circuit board 74. With such an arrangement, a portion of the connector 30 is located below the circuit board 74 which, as mentioned above, reduces the height of the connector 30 above the circuit board 74 and thus allows for a more efficient utilization of space inside a computer or the like.

Figure 11:
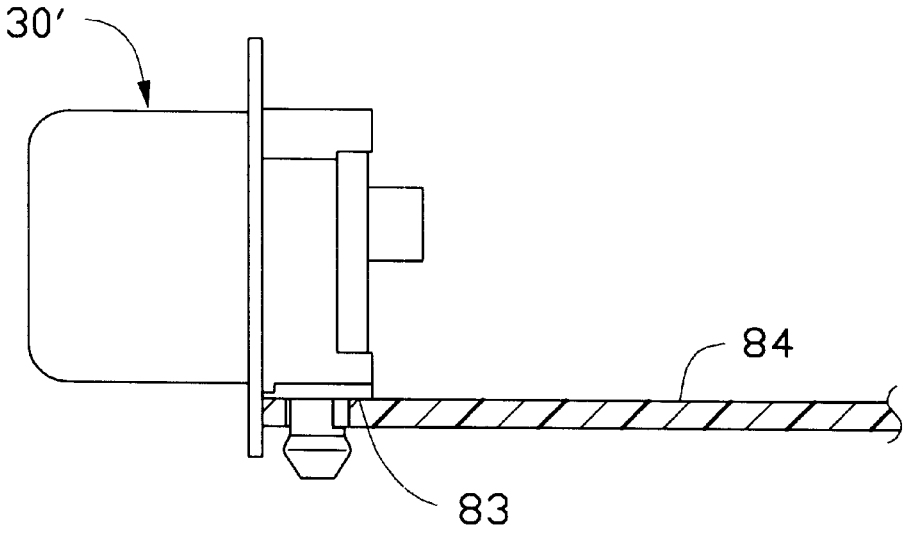
FIG. 11 is a side elevational view of the assembled connector of FIG. 10 mounted on a circuit board.
Figure 10:
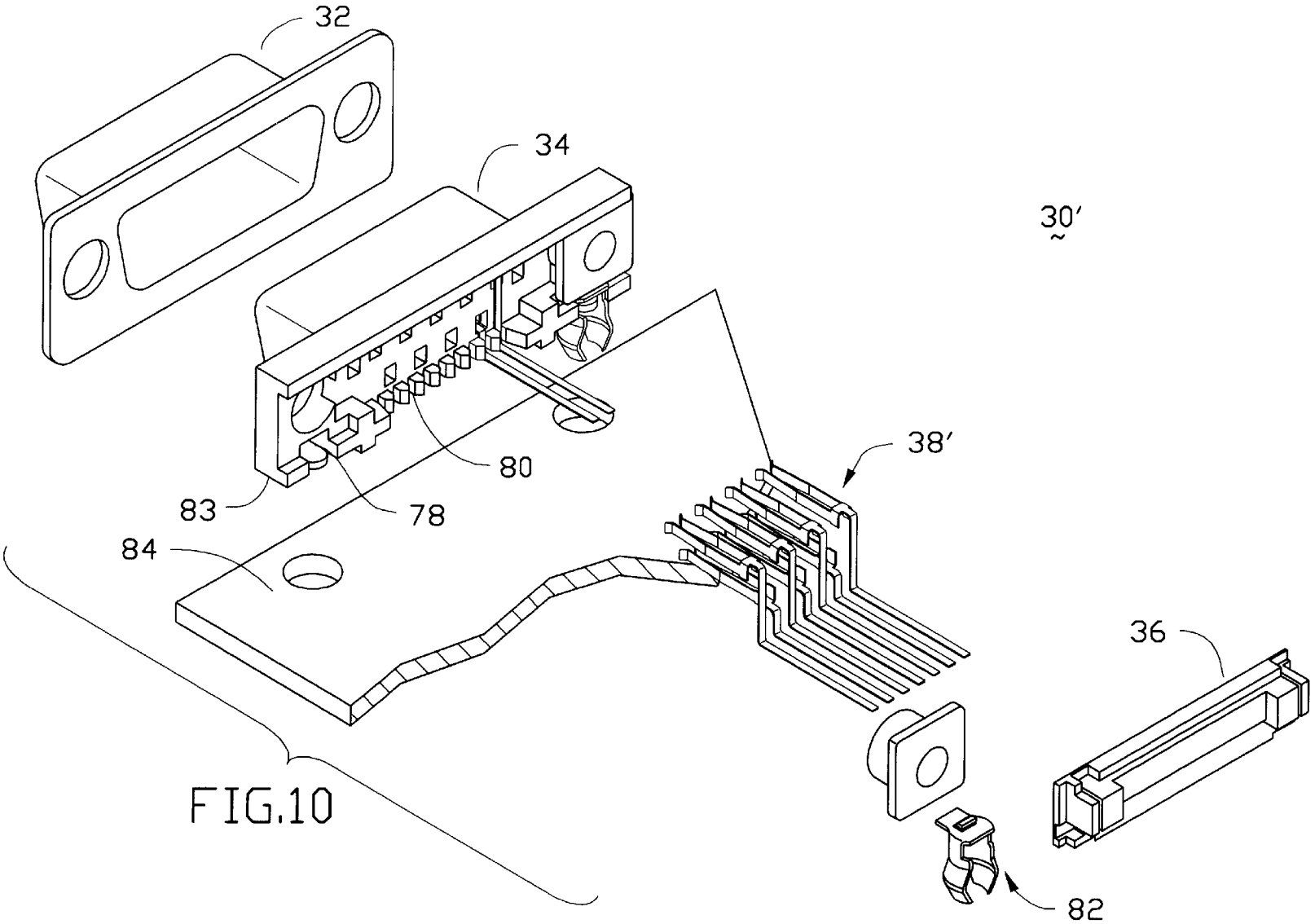
FIG. 10 is an exploded view of an electrical connector constructed in accordance with a second embodiment of the present invention.

In the first embodiment of the present invention, the connector 30 is mounted to the circuit board 74 by positioning the board mating surfaces 52 of the connector 30 on the circuit board 74. However, the connector can also be mounted to the circuit board by positioning the bottom face of the connector housing on the circuit board, as shown in FIGS. 10 and 11 which illustrate a second embodiment of the present invention.

In the second embodiment, the connector in accordance with the present invention is designated with reference numeral 30' for distinction. The connector 30' also comprises a housing 34 and a spacer 36 attached to the housing 34 for retaining a plurality of terminal pins 38' therebetween. A shielding shell 32 is fit over a projection of the housing 34 and secured thereto by means of fasteners 42. The housing 34 comprises terminal pin positioning means 80 for retaining the terminal pins 38' in position. In the second embodiment of the present connector 30', the boardlocks 40 of the first embodiment are replaced with two conventional boardlocks 82 received and retained in corresponding receiving spaces 78 provided in the connector housing 34. The boardlocks 82 have free ends extending beyond a bottom face 83 of the housing 34 to be received and retained in corresponding mounting holes 86 provided on a circuit board 84. Thus, the connector 30' is mounted to the circuit board 84 in a conventional fashion and is located above the circuit board 84.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An electrical connector adapted to be mounted on a circuit board, comprising:

an insulative body having a plurality of passages, a bottom face adapted to be located below the circuit board, and a board mating surface distanced from the bottom face in a direction substantially normal to the board mating surface, the board mating surface being adapted to be positioned on top of the circuit board;

a plurality of terminal pins received in the passages; and at least one boardlock comprising a body fixed to the insulative body and board engaging means extending from the body for engaging with counterpart means provided on the circuit board;

wherein the insulative body comprises a housing and a separate spacer secured to each other and retaining the terminal pins therebetween, and wherein the board mating surface is defined on a face of the spacer.

2. The electrical connector as claimed in claim 1 further comprising a shielding shell fitted over and secured to the housing.

3. The electrical connector as claimed in claim 2, wherein a pair of slots are provided on opposite ends of the spacer for receiving and retaining the corresponding boardlocks therein.

4. The electrical connector as claimed in claim 3, wherein the connector further comprises fasteners to secure the shell, the housing, the spacer and the boardlocks together.

5. The electrical connector as claimed in claim 4, wherein the spacer comprises a section to be engaged by each of the fasteners when securing the spacer to the housing.

6. The electrical connector as claimed in claim 5, wherein each of the boardlocks comprises at least a section to be fixed to the spacer.

7. The electrical connector as claimed in claim 6, wherein the slot of the spacer that receives the boardlock further comprises a first space for receiving a first section of the boardlock therein.

8. The electrical connector as claimed in claim 7, wherein the boardlock further comprises a second section and wherein the slot of the spacer that receives the boardlock further comprises a second space for receiving the second section of the boardlock therein.

9. The electrical connector as claimed in claim 6, wherein the boardlock comprises a cutout engaging with a projection provided inside the slot of the spacer for positioning the boardlock inside the slot.

10. An electrical connector adapted to be mounted on a circuit board, comprising a shielding shell, an insulative housing, an insulative spacer, a plurality of terminal pins and at least one boardlock, wherein the shell is fitted over and secured to the housing;

the insulative housing comprises a plurality of passages each receiving one of the terminal pins therein and a tail end of each terminal pin extending beyond the insulative housing; and the spacer comprises means for retaining the tail ends of the terminal pins and has at least one slot receiving the boardlock therein for mounting the electrical connector to the circuit board, a distance being provided between the circuit board and a bottom face of the connector, the bottom face being below the circuit board.

11. The electrical connector as claimed in claim 10, wherein the spacer comprises a board mating surface to be positioned on the circuit board.

12. The electrical connector as claimed in claim 10, wherein the spacer comprises a plurality of channels formed therein for extension of the terminal pins therethrough.

13. The electrical connector as claimed in claim 10, wherein said boardlock includes a body from which retention legs extend downward, said body of the boardlock and the associated retention legs are substantially positioned about a middle portion of said insulative housing in a vertical direction, thereby allowing the circuit board to be positioned about a mid-point of the insulative housing in said vertical direction.

14. An electrical connector adapted to be mounted to a circuit board, comprising:

an insulative housing adapted to sit on top of the circuit board having a plurality of passages formed therein and a bottom face adapted to be located below the circuit board;

a shielding shell fitted over and fixed to the housing;

a plurality of terminal pins received in the passages of the insulative housing and having tail ends extending beyond the housing;

a spacer made of an insulative material and adapted to sit on top of the circuit board, fixed to the housing and retaining the tail ends of the terminal pins in position;

at least one boardlock having fixing means and board engaging means, the fixing means being fixed to the spacer and the board engaging means mechanically engaging with the circuit board; and at least one fastener for securing the housing, the shielding shell, the spacer and the boardlock together.

15. An electrical connector adapted to be mounted to a circuit board at either of two elevations relative to the circuit board, comprising:

an insulative body having a plurality of passages and having a bottom face adapted to be located below the circuit board, a board mating surface distanced from the bottom face, first retaining means, and second retaining means;

a plurality of terminal pins received in corresponding passages with tail ends thereof extending beyond the insulative body;

at least one boardlock selected from a first and a distinctively different second boardlocks for mounting the insulative body to the circuit board, the first boardlock adapted to engage with the first retaining means to mount the connector to the circuit board at a elevation and the second boardlock adapted to engage with the second retaining means to mount the connector to the circuit board at a second elevation different from the first elevation;

wherein the bottom face of the insulative body is positioned on the circuit board when the first boardlock is mounted to the first retaining means, and the board mating surface is positioned on the circuit board when the second boardlock is mounted to the second retaining means.

16. The electrical connector as claimed in claim 15, wherein the insulative body comprises a housing and a separate spacer secured to each other and retaining the terminal pins therebetween, and wherein the board mating surface is defined on a face of the spacer and the bottom face is defined on the housing.

17. The electrical connector as claimed in claim 15, wherein the first retaining means is provided at a bottom side of the insulative body and the second retaining means is provided on opposite ends of the insulative body.

* * * * *